United States Patent [19]

Sansbury

[11] Patent Number: 4,598,906

[45] Date of Patent: Jul. 8, 1986

[54] DEVICE FOR ADJUSTABLY POSITIONING A CROSS BAR

[76] Inventor: Harold L. Sansbury, 1322 W. 264th St., Harbor City, Calif. 90710

[21] Appl. No.: 669,640

[22] Filed: Nov. 8, 1984

[51] Int. Cl.[4] ..... A63K 3/04; A63B 5/02; A62B 1/20; E04H 17/00

[52] U.S. Cl. ..... 272/103; 182/189; 256/11; 272/101

[58] Field of Search ..... 272/62–63, 272/100–104, 70.1, 70.2; 248/161, 159; 119/29; 182/189, 181, 100; 256/11

[56] References Cited

U.S. PATENT DOCUMENTS

| | | | |
|---|---|---|---|
| 1,193,972 | 8/1916 | Balenti | 272/102 |
| 3,612,460 | 10/1971 | Smith | 272/70.2 |
| 3,749,368 | 7/1973 | Miller | 256/11 |
| 3,771,767 | 11/1973 | Dougherty | 256/11 |
| 4,065,103 | 12/1977 | Sweezey | 256/11 |
| 4,245,838 | 1/1981 | Gordon | 272/101 |

FOREIGN PATENT DOCUMENTS

| | | | |
|---|---|---|---|
| 0519446 | 5/1953 | Belgium | 272/70.2 |

OTHER PUBLICATIONS

Popular Mechanics, pp. 114–115, 9/1963, vol. 120, #3.

*Primary Examiner*—Robert A. Hafer
*Assistant Examiner*—Kathleen D'Arrigo
*Attorney, Agent, or Firm*—Robert J. Schaap

[57] ABSTRACT

An apparatus and a method for enabling changes in the height of a cross bar in athletic equipment, such as pole vaulting equipment. The apparatus generally comprises a pair of adapters for attachment to the upright standards which have a plurality of outwardly extending arms thereon. The adapters also have arms which can be located above the uppermost of the arms on the standards or below the lowermost of the arms on the standards and which arms on the adapters are also located to receive and hold the cross bar thereon.

17 Claims, 15 Drawing Figures

DEVICE FOR ADJUSTABLY POSITIONING A CROSS BAR

BACKGROUND OF THE INVENTION

1. Field of the Invention

This invention relates in general to certain new and useful improvement in both apparatus and method for enabling changes in the height of a cross bar in athletic equipment, and more particularly, to an apparatus and method of the type stated which utilizes an adapter capable of being secured to one or both of a pair of standards holding the cross bar in such athletic equipment.

2. Brief Description of the Prior Art

There are many popular sports in which an athlete attempts to exceed the height of a cross bar through jumping action, either alone, or with the assist of some external member. For example, in the case of pole vaulting, the athlete uses a pole to assist in achieving a certain height.

Commercially available athletic equipment used in these activities, as for example, the pole vault assembly, usually includes a pair of uprights or so-called "standards" which have a cross bar extending therebetween. The pole vaulter uses a pole to aid in jumping over this cross bar at a selected height. In the case of that sport referred to as "high jumping" a similar type of equipment is employed and which includes a pair of spaced apart vertically disposed standards or uprights with a cross bar extending therebetween. Here again, the high jumper is required to jump at a sufficient height to cross over and clear the cross bar which extends between the standards or uprights.

In each of the aforementioned types of equipment, the height of the cross bar is capable of a limited adjustable positioning. Each of the standards may include a plurality of outwardly extending arms which removably retain the cross bar. Thus, if it is desired to raise the position or height of the cross bar, this cross bar is removed from a pair of arms on each of the standards and raised to an upwardly spaced pair of arms. In like manner, if it is desired to lower the height of the cross bar, that same cross bar is positioned on and removably retained on a pair of lower outwardly struck arms.

While this type of structure does permit some type of adjustable positioning, tht positioning of the cross bar is only available within a limited finite range. For example, the lowermost of the pair of arms on standard pole vaulting equipment is located about 10 feet above the ground level. The uppermost of the pairs of arms on standard pole vaulting equipment is approximately 17 feet 3 inches or 17 feet 6 inches above the ground level. In other words, the cross bar can be positioned at a selected dimension between a height no lower than 10 feet and a height no greater than 17 feet 3 inches or 17 feet 6 inches on standard college level pole vaulting equipment.

In many cases, depending on the level of skill of the athlete or upon the age and experience of the athlete, it is desirable to provide equipment in which the cross bar on these types of equipment can be positioned lower than 10 feet, as for example, in high school environments, elementary school environments and the like. In other cases, it may be desired to position the cross bar at even higher elevations than 17 feet six inches, as for example, with professional pole vaulters on high jumpers and the like.

Heretofore, in order to obtain equipment which permits positioning of the cross bar at a height beyond the standard predefined range of adjustable height positions, it was necessary to purchase speciality equipment. In other words, if a particular institution had equipment which permitted adjustable positioning of a cross bar between 10 feet and 17 feet 3 inches, it was necessary to obtain alternate equipment which permitted positioning of the cross bar at an elevation below 10 feet or still additional equipment which permitted positioning at an elevation above 17 feet 3 inches. Equipment of this type is quite expensive and therefore, particularly with institutions having limited budgets, it was not readily available.

The present invention obviates these and other problems in the provision of an adapter to standard conventional athletic equipment of this type which permits the raising of a cross bar above a normal pre-determined range of positions and positioning of the cross bar below a pre-determined range of positions.

OBJECTS OF THE INVENTION

It is, therefore, one of the primary objects of the present invention to provide an adapter capable of being attached to a structure forming part of athletic equipment having a pair of uprights with a cross bar extending therebetween and which enables adjustable positioning of a cross bar at a height beyond that normally available with the equipment.

It is another object of the present invention to provide an adapter of the type stated which is capable of being attached to the uprights or standards of this athletic equipment and which contains outwardly extending arms for removably holding the cross bar at an elevation above or below that normally attainable with the standard athletic equipment.

It is a further object of the present invention to provide an adapter system of the type stated in which each of a pair of adapters are attached to the standards of the athletic equipment in a parallel vertically disposed arrangement and contain outwardly struck arms which are capable of removably holding a cross bar therebetween.

It is an additional object of the present invention to provide an adapter of the type stated which can be manufactured at a relatively low cost, but which is highly efficient in its operation.

It is another salient object of the present invention to provide athletic equipment which is constructed so that a cross bar can be positioned above or below the normal height elevations on the equipment as initially manufactured.

It is another salient object of the present invention to provide a method of positioning a cross bar on a pair of standards in athletic equipment at a height greater than that normally available with the equipment or a height below that normally obtainable with the athletic equipment.

With the above and other objects in view, my invention resides in the novel features of form, construction, arrangement and combination of parts presently described and pointed out in the claims.

BRIEF SUMMARY OF THE DISCLOSURE

An adapter for attachment to standards of athletic equipment of the type having a pair of spaced apart upright standards with a cross bar therebetween. This type of athletic equipment is often referred to as athletic assemblies since they contain separable individual components. Assemblies of this type are typically used in sports activities, such as, for example, pole vaulting, high jumping and the like.

The adapter of the present invention enables the position of the cross bar to be raised above that normally attainable with the conventional equipment as acquired. Furthermore, the adapter permits the lowering of the cross bar to a height beneath that which is normlly attainable by such athletic or sports type equipment.

The adapter of the present invention comprises an elongate relatively rigid frame which is adapted for vertical disposition in parallel relation to the standard of the assembly. A means is associated with this frame for attachment to the standard in such manner as to have the length of the frame generally parallel to that of the standard and to be closely spaced with respect to the standard.

The frame carries at least one outwardly extending arm of a type which is similar to those found on the standards. This outwardly extending arm on the frame is adapted to extend generally in the same direction as the one or more arms on the standards and which arm or arms on the frame can be above the uppermost of the arms of the standard or below the lowermost of the arms on the standard, when the frame is connected thereto, and are also adapted to receive and hold the cross bar thereon.

In actual use, a separate frame would be attached to each of the pair of spaced apart standards. Moreover, each of the frames would be generally positioned at the same height on the standards so that the arms on the frames are also located approximately at the same height to receive a cross bar in generally parallel relationship to the ground surface.

In more detail, the means associated with the frame for attachment to the standard may adopt the form of an aperture in the frame which is sized and located to receive an outwardly extending arm on the standard. In this way, the frame can be effectively supported on the arm through the aperture. Moreover, the frame is normally located on the standard such that it is in abutted engagement with a surface of the standard. The standards are often of circular cross sectional shape and the frame may therefore have an arcuate contour so as to conform to a portion of the exterior shape of the standard.

In addition, the means associated with the frame for attachment to the standard may also comprise a strap which is adapted to encircle the frame and the standard to thereby retentively hold the frame on the standard.

The aperture in the frame which receives the arm on the standard is located on the frame so that the distance between the lower end or the upper end of the frame and the aperture is less than the distance between each of a pair of arms on the standard.

In a more preferred embodiment, the frames may also have a plurality of vertically spaced apart arms thereon and which extend outwardly in the same direction as the arms on the standard when the frame is secured to the standard. Moreover, the spacing of the outwardly extending arms on the frame is about the same as the spacing between the vertically spaced apart arms on the standard.

The present invention also provides a method of raising and lowering the depth of a cross bar on a pair of spaced apart vertically disposed standards forming part of athletic equipment and wherein an athlete attempts to propel himself or herself over the cross bar. The method comprises locating a separate relatively rigid frame in closely spaced relationship to each of a pair of spaced apart standards in generally vertically disposition and in generally parallel relationship to the standards. The method thereafter comprises fixedly, but removably attaching each of the frames to a separate one of each of the standards. Further, the method comprises the removing of the cross bar extending between each of a pair of outwardly extending arms on the standards and re-positioning the cross bar on outwardly extending arms on each of the frames and in a position which is either above or below the uppermost or the lowermost of the arms on each of the standards.

This invention possesses many other advantages and has other purposes which may be made more clearly apparent from a consideration of forms in which it may be embodied. These forms are shown in the drawings accompanying and forming part of the present specification. They will now be described in detail, for purposes of illustrating the general principles of the invention, but it is to be understood that such descriptions are not to be taken in a limiting sense.

BRIEF DESCRIPTION OF THE DRAWINGS

Figure 1:
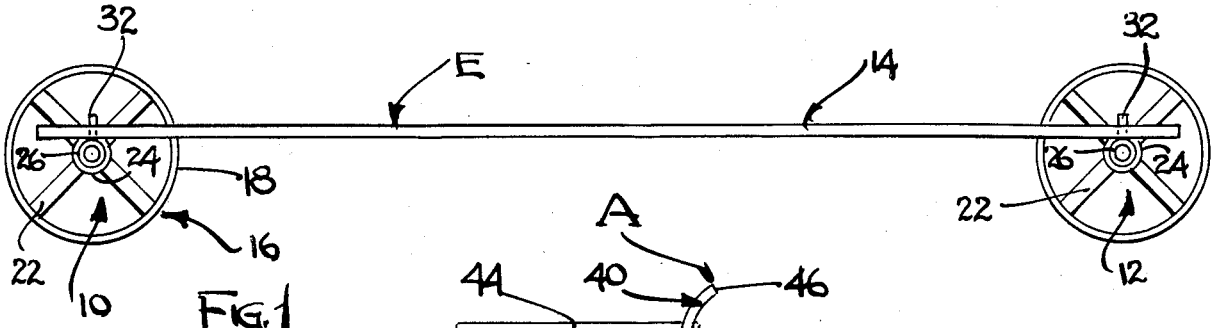
Figure 4:
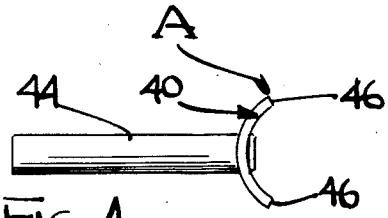
Figure 2:
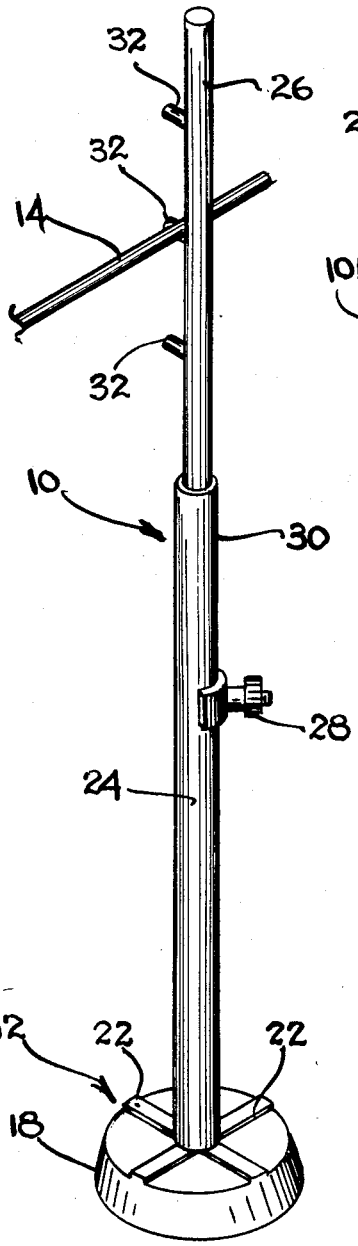
Figure 10:
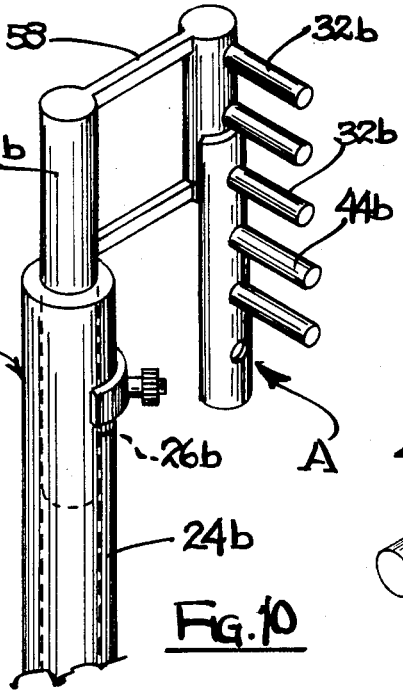
Figure 11:
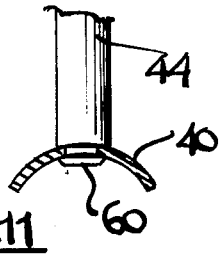
Figure 12:
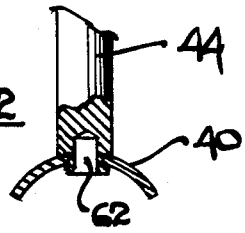
Figure 3:
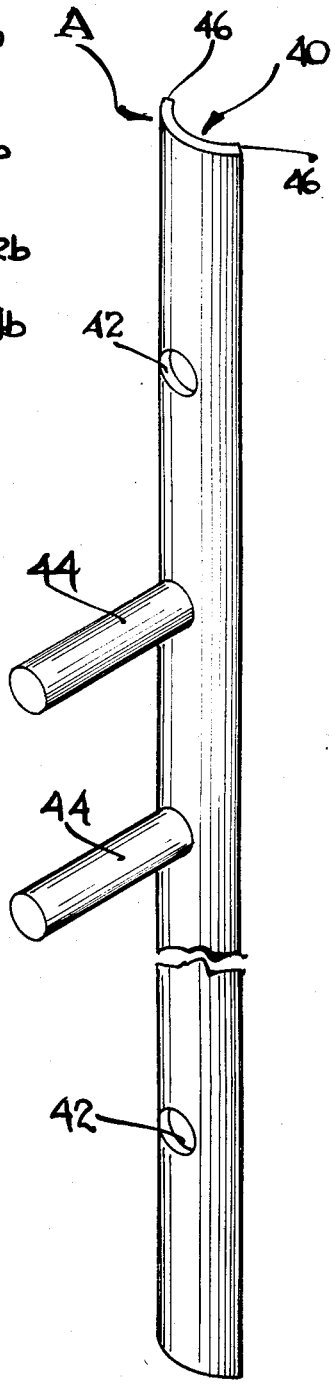
Figure 7:
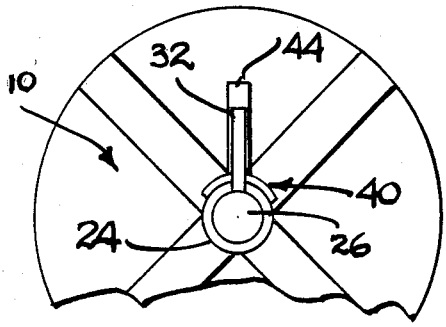
Figure 9:
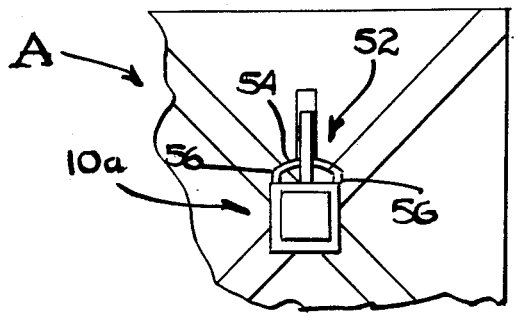
Figure 8:
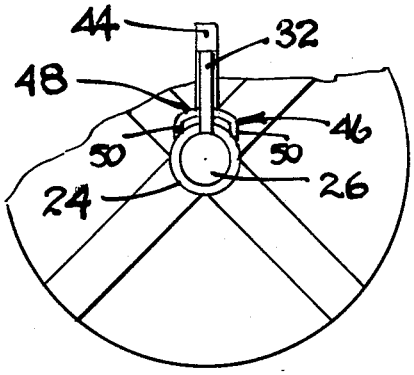
Figure 14:
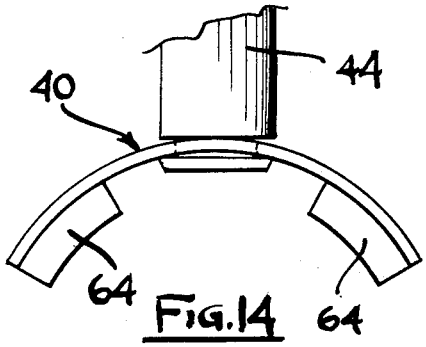
Figure 13:
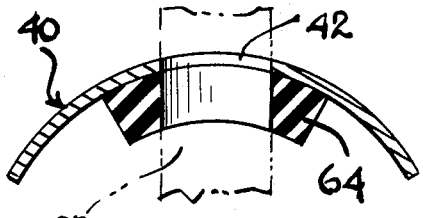
Figure 5:
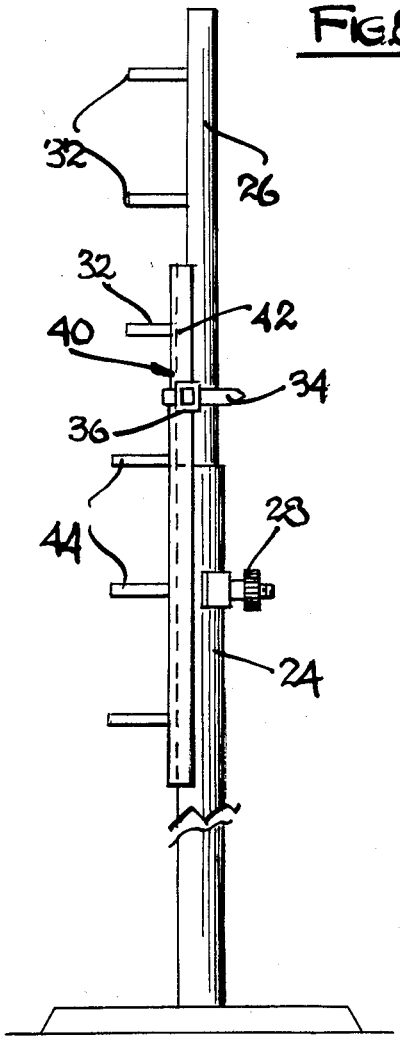
Figure 6:
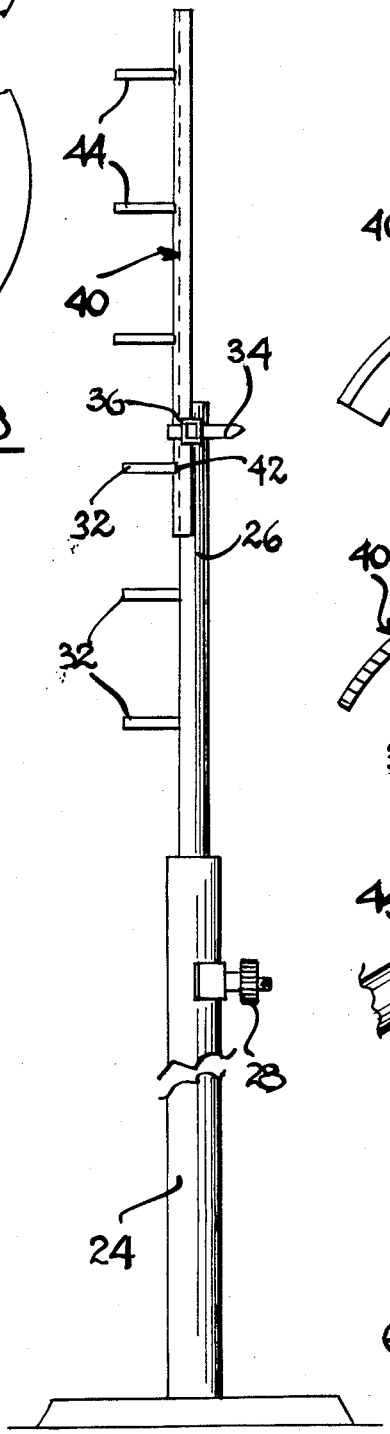
Figure 15:
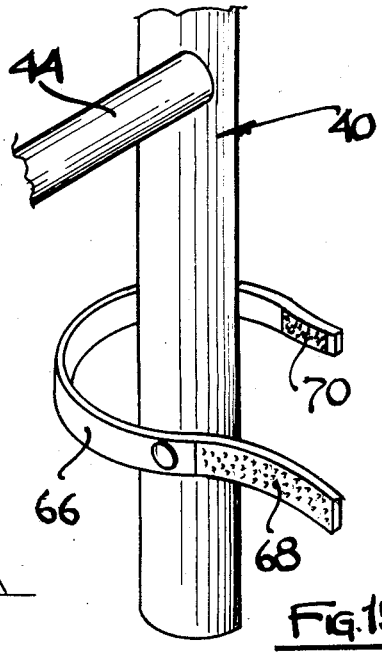

Having thus described the invention in general terms, reference will now be made to the accompanying drawings (2 sheets) in which:

FIG. 1 is a top plan view of athletic equipment with which the adapters of the present invention may be used;

FIG. 2 is a perspective view of one of the standards forming part of the athletic equipment with which the adapters of the present invention may be employed;

FIG. 3 is a fragmentary perspective view of one form of adapter constructed in accordance with and embodying the present invention;

FIG. 4 is a top plan view of the adapter of FIG. 3;

FIG. 5 is a fragmentary side elevational view of one of the standards of the athletic equipment with an adapter of the present invention attached thereto;

FIG. 6 is a fragmentary side elevational view similar to FIG. 5, and showing the adapter of the present invention in a different position on the standard;

FIG. 7 is a fragmentary top plan view of the standard of FIG. 6 with the adapter connected thereto;

FIG. 8 is a fragmentary top plan view of the standard of FIG. 5 with a modified form of adapter attached thereto;

FIG. 9 is a fragmentary top plan view of an adapter of the present invention used with a standard having a generally rectangular cross-sectional shape;

FIG. 10 is a fragmentary perspective view of an adapter of the present invention used with a standard having an extension thereon;

FIG. 11 is a top plan view, partially in section, showing one means of attaching a cross bar supporting arm to the frame of the adapter;

FIG. 12 is a top plan view, partially broken away and in section, similar to FIG. 11, and showing another embodiment of attaching a cross bar supporting arm to the frame of the adapter;

FIG. 13 is a horizontal sectional view of another embodiment of an adapter constructed in accordance with and embodying the present invention;

FIG. 14 is a fragmentary top plan view of still another alternate embodiment of an adapter constructed in accordance with and embodying the present invention; and FIG. 15 is a fragmentary perspective view of still a further embodiment of an adapter constructed in accordance with and embodying the present invention.

DETAILED DESCRIPTION OF PREFERRED EMBODIMENTS

Referring now in more detail and by reference characters to the drawings which illustrate practical embodiments of the present invention, E designates athletic equipment of the type with which an adapter A of the present invention may be used.

As indicated previously, this athletic equipment adopts the form of pole vaulting equipment or high jumping equipment or the like. Generally, and in the case of pole vaulting equipment, a pair of upright pole assemblies or so-called "standards" 10 and 12 are provided to support a cross bar 14 over which an athlete attempts to propel himself or herself. Each of the standards 10 and 12 are suitably mounted on bases 16 which may adopt the form of a circularly shaped base rim 18 and having a center hub 20 connected by a plurality of spokes 22. The hub 20 is adapted to receive and support the upstanding standards 10 or 12 in an upright position.

Each of the standards 10 and 12 are substantially identical in construction, and one of these standards 10 is more fully illustrated in FIGS. 2, 5 and 6. It can be observed that the standard 10 is constructed of a first fixed tube 24 which concentrically receives a telescopic, vertically shiftable pole 26, in the manner as shown in FIGS. 2, 5 and 6. When the pole 26 has been raised to a desired elevation, it can be locked in that elevation by means of a pin or bolt 28 which can be turned and locked. The shank of the bolt 28 is movable through an elongate slot 30 formed in the wall of the tube 24, in the manner as illustrated.

Each of the vertically shiftable poles 26 of each of the standards are provided with a plurality of outwardly extending arms 32 which are located in vertically spaced apart relationship. In the case of conventional pole vaulting equipment, each one of the arms on a standard are spaced either about 12 inches apart from each other or about 6 inches apart from each other.

In actual use, each of the poles 26 of each of the standards 10 and 12 are raised to the same elevation. The cross bar is thereupon held on a pair of arms 32 which are at the same elevation. When it is desired to either raise or lower the position of the cross bar 14, the user merely places the cross bar 14 on a higher set of arms 32 or on a lower set of arms 32. Positioning of the cross bar 14 between the pairs of arms can also be accomplished by shifting the poles 26 within the tubes 24 and locking the poles 24 in a desired position.

It can be observed that when the poles 26 have reached their uppermost limit of movement, the highest elevation achievable by the cross bar 14 is by holding the cross bar on the uppermost of the arms or rungs 32. In like manner, in order to achieve the lowermost position, the poles 26 are inserted concentrically within the tubes 24 to their lowermost position and the cross bar 14 is positioned on the lowermost of the arms 32 on each of the standards.

When it is desired to achieve a height for the cross bar 14 which is greater than that provided by the maximum extension of the poles 26 or to permit a height which is lower than that provided by the maximum retraction and insertion of the poles 26 within the tubes 24, the adapter A of the present invention may be used. The adapter A generally comprises a frame 40 which is elongate and has an arcuate shape in cross-section, as illustrated in FIG. 4. An individual frame 40 would be provided for attachment to each of the standards, as hereinafter described in more detail.

Each of the frames 40 is provided with an attachment means in the nature of at least one or more apertures 42 located toward the upper and lowermost ends of the frame 40 when the latter is located in a vertical or upright disposition. These apertures 42 are sized to receive the uppermost or the lowermost of the arms 32 on the standards. Thus, and in this way, the frames 40 can be effectively supported by one of the arms 32 of the standards. It should be understood that one or more of such apertures could be formed in each frame. As an additional fastening means, a belt or strap 34 with a conventional means of connecting the ends together, e.g. a buckle 36, could be provided to encircle the standard and the frame 40 to retentively hold the latter on the standard. Preferably, the belt extends around the pole 26.

Each of the frames 40 are also provided with a pair of outwardly extending arms 44 substantially similar to the arms 32 on the standards. Moreover, the spacing between each of the vertically spaced apart arms 44 on the frame 40 is effectively the same as the spacing between each of the arms 32 on the standards 10 and 12. Thus, in order to raise the height of a cross bar beyond the maximum height obtainable by any one of the standards 10 and 12, the frames 40 are attached to the standards in the manner as illustrated in FIG. 6. In this case, one of the arms 32 such as the uppermost arm 32 on the standard would be inserted into the lowermost aperture 42 on the frame. A similar frame would be located in the same position on each of the standards 10 and 12. In this way, it can be observed that the cross bar can be raised to a desired position and supported by one of the arms on one frame and a corresponding arm on the other frame.

When it is desired to achieve a lower position for the cross bar than that which can be obtained by use of the standards alone, the frame 40 is disposed on each of the standards in the position as illustrated in FIG. 5. In this case, the uppermost of the apertures 42 on the frames would be adapted to receive the lowermost of the arms 32 on each of the individual standards. In this way, the cross bar can then be inserted on any one of the arms 44 of one adapter 40 and a corresponding arm on the other adapter 40.

By reference to FIG. 7, it can be observed that the frame 40 has an arcuate shape with an interior surface having a radius essentially the same as the radius forming the exterior surface of one of the poles 24 forming part of the standard. In this way, the frame 40 conforms to and has its interior surface in contact with the annular surface of either of the standards 10 or 12. Moreover, the frame 40 can be snugly engaged against and removably attached to the standard in the manner as previously described.

FIG. 8 illustrates a slightly modified form of frame 46 which has a somewhat arcuate vertically disposed surface 48 and a pair of integrally formed, rearwardly extending, abutment flanges 50. By reference to FIG. 8, it can be observed that these flanges 50 extend to and abut the annular surface of the pole 26 or otherwise, the column forming part of the standard in the manner as illustrated in FIG. 8. The vertically disposed section 48 in this embodiment is slightly spaced from the standard. Moreover, it can be observed that the frame 46 is capable of being used with a large number of standards having different diametrical sizes.

FIG. 9 illustrates yet another embodiment of a frame 52 which is capable of being used with other forms of standards, as for example, a standard 10*a* which is rectangular in cross sectional shape. In this case, the frame 52 also has an arcuate surface 54 with a pair of rearwardly extending flanges 56. The rearward edges of the flanges 56 are located in abutting engagement with one flat surface of the standard 10*a*, in the manner as illustrated in FIG. 9. It should be understood that the dimension between the flanges 56 could vary depending upon the type of equipment with which the frame is to be used and for that matter, the radius of the arcuate surface 54 could vary depending upon the type of equipment with which the frame is to be used.

FIG. 10 illustrates the use of the adapters of the present invention on standards 10*b* which have a vertically disposed column or tube 24*b* which concentrically receives a telescopic vertically shiftable pole 26*b*, in the manner as illustrated in FIG. 10. In this embodiment, the upper end of the pole 26*b* is provided with an extension 58 having a plurality of outwardly extending arms 32*b*. In this case, the standard 10*b* is used with a like standard (not shown) such that each of the extensions 58 are facing toward each other. Moreover, the arms 32*b* extend outwardly in the same direction as the arms 32 on the standards illustrated in FIGS. 5 and 6. In this way, the standards 10*b* and 12*b* will be able to be spaced further apart from each other permitting some horizontal displacement.

By further reference to FIG. 10, it can be observed that the adapter A of the present invention is connected to one of the arms 32*b* on the extension 58. A like adapter A would also be extended from and supported by a similar arm 32*b* on an extension 58 of the oppositely disposed standard.

In a more preferred embodiment of the invention, as shown in FIG. 3, for example, each of the frames have an overall length of about 41½ inches. Furthermore, the distance between the uppermost of the apertures 42 from the upper end of the frame is approximately five inches. The distance between the uppermost aperture 42 and the first arm 44 is approximately 12 inches. The distance between each of the other adjacent arms is also about 12 inches. Also in this preferred embodiment, the arcuate shape is formed such that it has about a three eighth's inch radius with rear edges 46. Each of the arms 44 are formed of one half inch diameter bar stock.

In one embodiment of the invention, the arm 44 can be secured to the frame 40 by means of an upset flared head 60, as illustrated in FIG. 11. In another embodiment of the invention, the arm 44 can be secured to the frame 40 by means of a different type of pressure flared end 62, as illustrated in FIG. 12. The exact means of attaching the arms 44 to the frames 40 is not critical in accordance with the present invention and for that matter, the arms can be secured to the frames by any conventional attachment means.

In a more preferred embodiment of the invention, the frames of the adapter A and for that matter, the arms, are preferably formed of a lightweight metal, such as aluminum or the like. However, it should be understood that the adapters A can be formed of other heavier metals, if desired, such as steel or the like. Furthermore, they could be formed of other non-metal materials, such as plastics, or reinforced plastics or the like. When the adapters are formed of a metal, they preferably should be cadmium plated for protection and appearance. When formed of an aluminum they can be conveniently and easily extruded. When formed of a plastic, they can be easily and conventionally injection molded. If formed of a ferrous material, the frames can be easily cast or forged.

FIG. 13 illustrates an embodiment of the invention in which a spacer 64 may be used with one or both of the frames 40. In this case, the spacer is secured to the interior portion of the frame 40 and is centrally located on the interior surface, in the manner as illustrated in FIG. 13. Additional spacers 64 could also be located on the interior surface of the frame over the length thereof.

The spacer 64, as illustrated, as well as any additional vertically spaced apart spacers are formed of a somewhat soft and compressible material, such as a urethane rubber or the like. The spacers 64 thus allow the frame 40 to be disposed against both the pole 26 and the tube 24 and compensate for the slightly different diameter of each, thereby enabling a snug fitting engagement against the standard. The spacers 64 also preclude the inner ends of the arms 44 from engaging and scratching or otherwise abrading the surface of the column and also protects the columm from direct engagement with the interior surface of the frame 40.

FIG. 14 illustrates a modified embodiment of the invention which utilizes a pair of the spacers 64 on the oppositely disposed edges thereof. In this case, the spacers also preclude interference with the pole 26 from entering into the tube 24. Moreover, the spacers will not interfere with a vertical shifting arrangement of the pole 26 with respect to the tube 24 and will also serve to preclude scratching or abrasion to the standards.

FIG. 15 illustrates an embodiment of the invention in which there is an additional fastening means forming part of the adapter of the present invention. In this case, a flexible strap 66 is connected to one end of the frame, as for example, the lower end, as illustrated. This strap would have a Velcro type strip 68 on an exterior surface of one end and a mating Velcro type strip 70 on the interior surface of the opposite end of the strap. In this way, the adapter can be further releasably secured to the standards. It should be understood that other forms of attachment means could also be provided in accordance with the present invention.

Thus there has been illustrated and described a unique and novel adapter for athletic equipment having a cross bar and which enables the raising of the cross bar to a height greater than or lower than that normally attainable by the equipment. Thus, the adapter of the present invention and the athletic assembly used with that adapter as well as the method of the invention thereby fulfills all of the objects and advantages which have been sought. It should be understood that many changes, modifications, variations and other uses and applications will become apparent to those skilled in the art after considering this specification and the accompanying drawings. Therefore, any and all such changes, modifications, variations and other uses and applications are deemed to be covered by the invention which is limited only by the following claims.

Having thus described my invention, what I desire to claim and secure by Letters Patent is:

1. An adapter set comprised of a pair of adaptors for attachment to a pair of upright standards forming part of athletic equipment with a plurality of vertically spaced apart outwardly extending arms on each of said standards and a cross bar supported by one or more arms on the standards, each said adaptor comprising:

(a) an elongate relatively rigid frame adapted for vertical disposition parallel to one of the standards of said athletic equipment, (b) means forming an aperture in each said frame for attachment to an associated standard in such manner so as to have its length generally parallel to that of the standard and to be closely spaced thereto, the aperture on each said frame being located so that the distance between the upper end or lower end of the frame and the aperture is less than the distance between each of a pair of arms on each said standard, and (c) at least one arm on each said frame extending outwardly therefrom in generally the same direction as the one or more arms on the standards and which arm on each frame can be located above the uppermost of the arms on the standards or below the lowermost of the arms on the standards and are also adapted to receive and hold the end of a cross bar thereon, the aperture on each frame being sized to receive an outwardly extending arm on one of the standards.

2. The adapter set of claim 1 further characterized in that the means associated with said each frame comprises a strap means adapted to encircle a standard in addition to said aperture in each frame.

3. The adapter set of claim 1 further characterized in that said frames are located in abutted engagement with said standards when attached thereto.

4. An athletic assembly in which a user attempts to propel himself or herself over a cross bar supported on a pair of arms with each on a separate standard so that the cross bar extends between the pair of upright standards and where the cross bar can be raised or lowered above and below the height normally attainable by said assembly, said assembly comprising:

(a) a pair of spaced apart vertically disposed standards, (b) at least one outwardly extending arm on each of said standards, (c) a cross bar normally positionable and removably held by an arm at the same elevation on each of said standards, (d) a separate elongate relatively rigid upright frame adapted for vertical disposition with respect to and vertically parallel to each of the standards of said assembly, (e) means associated with each of said frames for attachment to an associated standard in such manner so as to have its length generally parallel to that of the standard and to be closely spaced thereto, and (f) at least one outwardly extending arm on each of said frames adapted to extend outwardly therefrom in generally the same direction as the one or more arms on the standards and which arms on the frames can be above the uppermost of the arms on the standards and are adapted to receive the hold ends of a cross bar thereon.

5. The athletic assembly of claim 4 further characterized in that the means associated with each said frame is an aperture adapted to receive an outwardly extending arm on said standard.

6. The athletic assembly of claim 5 further characterized in that the means associated with each said frame comprises a strap means adapted to encircle said standard to which said frame is attached in addition to said aperture.

7. The athletic assembly of claim 5 further characterized in that said standards are each provided with a plurality of vertically spaced apart outwardly extending arms, and said aperture is located on said frame so that the distance between the lower end or the upper end of said frame and the aperture is less than the distance between each of a pair of arms on said standard.

8. The athletic assembly of claim 4 further characterized in that each said frame is located in abutted engagement with a separate standard when attached thereto.

9. The athletic assembly of claim 4 further characterized in that a plurality of vertically spaced apart outwardly extending arms are on each of said frame.

10. The athletic assembly of claim 9 further characterized in that the spacing of the outwardly extending arms on each said frame in about the same as the spacing between the vertically spaced apart arms on each said standard.

11. The athletic assembly of claim 4 further characterized in that each said standard is mounted at its lower end in a somewhat circularly shaped base.

12. A pair of adapters for attachment to the standards of athletic equipment having a pair of spaced apart upright standards with each standard having a plurality of vertically spaced apart outwardly extending arms, and a cross bar extending therebetween to enable the raising or lowering of the height of said cross bar, each said adapter comprising:

(a) an elongate relatively rigid frame adapted for vertically disposed abutted engagement against a standard and parallel to such standard, (b) an aperture in each said frame to enable attachment to said standard in such manner so as to have its length generally parallel to that of the standard and to be closely spaced thereto, said aperture in each frame is located on said frame so that the distance between the lower end or the upper end of said frame and the aperture is less than the distance between each of a pair of arms on a standard, and (c) a plurality of vertically spaced apart outwardly extending arms on each of said frames and adapted to extend outwardly therefrom in generally the same direction as the one or more arms on the standards and which arms on the frames can be above the uppermost of the arms on the standards or below the lowermost of the arms on the standards and are also adapted to receive and hold a cross bar thereon, the spacing of the outwardly extending arms on each said frame is about the same as the spacing between the vertically spaced apart arms on said standards.

13. A method of raising or lowering the height of a cross bar supported by spaced apart vertically disposed standards of athletic equipment wherein an athlete attempts to propel himself over said cross bar, said method comprising:

(a) locating a relatively rigid frame in closely spaced relationship to each of said spaced apart standards in generally vertical disposition and generally parallel to said standards, (b) rigidly but removably attaching each of said frames to a separate one of each of said standards by permitting insertion of an outwardly struck arm on each standard into an aperture on a separate one of the frames, and (c) re-positioning said cross bar on outwardly extending arms on each of said frames and in a position which is above or below the uppermost or the lowermost of the arms on each of said standards.

14. The method of claim 13 further characterized in that said method additionally comprises encircling a strap about said standard and the frame associated therewith.

15. The method of claim 13 further characterized in that said method comprises locating said frame in abutted engagement with said standard when attaching same thereto.

16. An adapter set comprised of a pair of adaptors for attachment to a pair of upright standards forming part of athletic equipment with one or more outwardly extending arms on each of said standards and a cross bar supported by one or more arms on the standards, each said adaptor comprising:

(a) an elongate relatively rigid frame adapted for vertical disposition parallel to one of the standards of said athletic equipment, (b) means associated with each said frame for attachment to an associated standard in such manner so as to have its length generally parallel to that of the standard and to be closely spaced thereto, and (c) a plurality of vertically spaced apart outwardly extending arms on each said frame extending outwardly therefrom in generally the same direction as the one or more arms on the standards and which arms on the frames can be located above the uppermost of the arms on the standards or below the lowermost of the arms on the standards and are also adapted to receive and hold the ends of a cross bar thereon.

17. The adapter set of claim 16 further characterized in that the spacing of the outwardly extending arms on each said frame is about the same as the spacing between the vertically spaced apart arms on each of said standards.

* * * * *